US006290903B1

(12) United States Patent
Grace, Jr. et al.

(10) Patent No.: US 6,290,903 B1
(45) Date of Patent: Sep. 18, 2001

(54) BROADHEAD AND METHOD OF MANUFACTURE

(76) Inventors: Louis Grace, Jr., 4430 Vincent Rd., North Street, MI (US) 48074; Nathaniel G. Grace, 5586 Lapeer Rd., Apartment 5C, Kimball, MI (US) 48041; Matthew L. Grace, P.O. Box 90, Memphis, MI (US) 48049

( * ) Notice: Subject to any disclaimer, the term of this patent is extended or adjusted under 35 U.S.C. 154(b) by 0 days.

(21) Appl. No.: 09/546,146

(22) Filed: Apr. 10, 2000

(51) Int. Cl.[7] ..... B22F 3/00; B22F 3/24

(52) U.S. Cl. ..... 419/28; 419/36; 419/38; 419/48

(58) Field of Search ..... 419/28, 36, 38, 419/48; 473/583

(56) References Cited

U.S. PATENT DOCUMENTS

| | | | | |
|---|---|---|---|---|
| D. 406,305 | | 3/1999 | Runde | D22/115 |
| 3,915,455 | * | 10/1975 | Savora | 273/106.5 B |
| 4,093,230 | * | 6/1978 | Simo | 273/106.5 B |
| 5,078,407 | * | 1/1992 | Carlston et al. | 273/421 |
| 5,203,573 | * | 4/1993 | Brailean | 273/422 |
| 5,482,293 | * | 1/1996 | Lekavich | 273/422 |
| 5,931,751 | * | 8/1999 | Cooper | 473/578 |

OTHER PUBLICATIONS

"An Introduction to Injection Molding Metals & Ceramics", Jun. 1999, pp. 4–5.
"Bowhunting Equipment", 1999 Buyers Guide, p. 70.
Web site for Cabela's—http://www.cabelas.com, "BoneBuster® Braodheads".

* cited by examiner

*Primary Examiner*—Ngoclan Mai
(74) *Attorney, Agent, or Firm*—Harnes, Dickey & Pierce, P.L.C.

(57) ABSTRACT

The present invention relates generally to a monolithic broadhead including a ferrule and a blade having a tapered cross-section. The ferrule is formed with a threaded portion for attaching the broadhead to an arrow shaft in a conventional manner. Through the use of powdered metallurgy, the blade may be formed of a metal having a high hardness for maintaining edge sharpness and the ferrule may be formed of a high strength material for maintaining the durability of the broadhead.

12 Claims, 8 Drawing Sheets powder
binder
100
premixing
102
102a
mixing&
pelletizing
102b
104
injection
molding
80
thermal
debinding/
presintering
solvent
debinding
106
sintering
108

BROADHEAD AND METHOD OF MANUFACTURE

BACKGROUND AND SUMMARY OF THE INVENTION

The present invention relates generally to broadheads for an archery arrow and more specifically to the design and method of manufacture of a monolithic broadhead.

Conventionally archery broadheads are fabricated from multiple components which are secured together with an adhesive or other fastening means. A typical "cut on impact" broadhead includes a ferrule and a blade having a constant thickness which is secured to the ferrule. Broadheads of this type have the disadvantage of being relatively costly to manufacture and the blade may separate from the ferrule during usage. Accordingly, there is a need to provide an improved broadhead and method of manufacture which overcomes these disadvantages.

It is an object of the present invention to provide a monolithic broadhead.

It is an additional object of the present invention to provide a monolithic broadhead incorporating different metals for different components of the broadhead.

It is another object of the present invention to provide a manufacturing method for a broadhead using a powdered metallurgical process which improves tolerancing and control over the shape of the broadhead.

It is a further object of the present invention to provide a manufacturing method for a broadhead having a tapered blade using a powdered red metallurgical process.

In accordance with the present invention, a monolithic broadhead is provided including a ferrule, a blade or body and a tip. The blade may be provided with a tapered cross-section or other non-constant thickness. The ferrule is formed with a threaded portion for attaching the broadhead to an arrow shaft in a conventional manner. The use of powdered metallurgy and subsequent sintering process enables the blade to be formed of a metal having a high hardness so as to maintain the edge sharpness and the ferrule portion to be formed of a high strength material so as to maintain the durability of the broadhead.

These and other objects, features and advantages of the present invention will become apparent from the following description when viewed in accordance with the accompanying drawing and appended claims.

DETAILED DESCRIPTION OF THE PREFERRED EMBODIMENT

Figure 1:
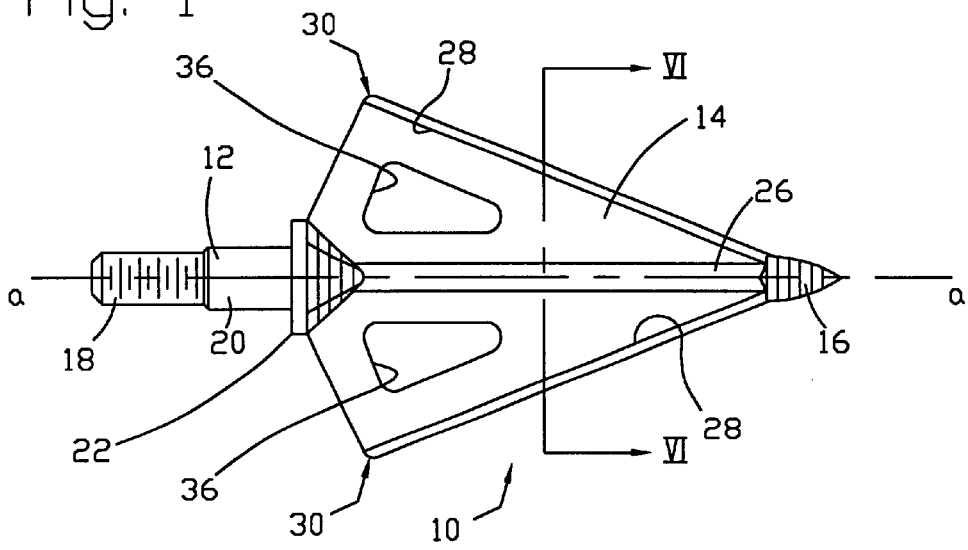
FIG. 1 is a top plan view of a first preferred embodiment of an archery broadhead in accordance with the present invention.
Figure 2:
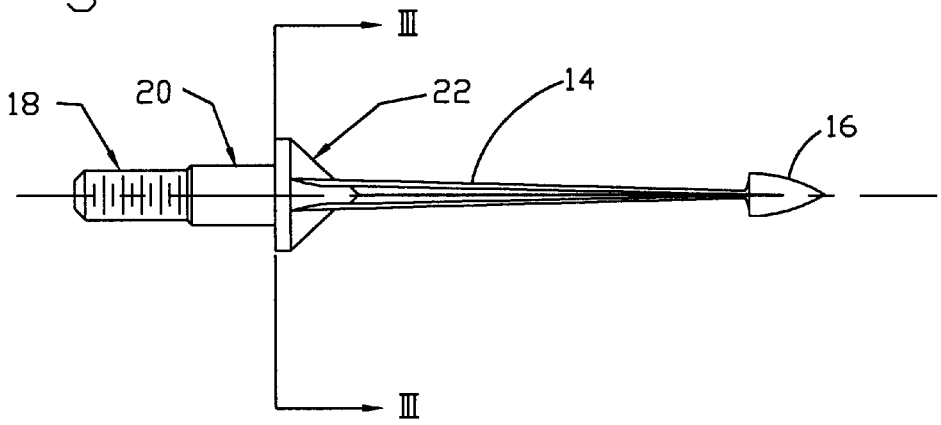
FIG. 2 is a side view of the broadhead illustrated in FIG. 1.
Figure 3:
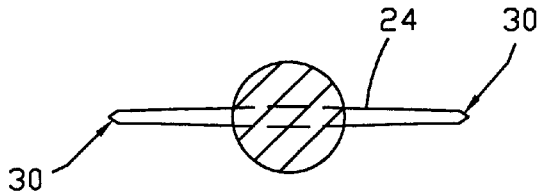
FIG. 3 is an cross-sectional view taken through line III—III in FIG. 2.
Figure 4:
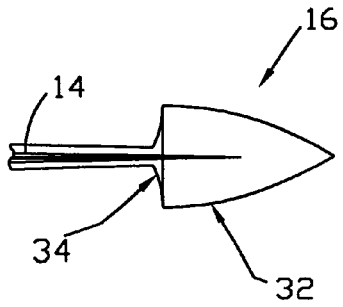
FIG. 4 is a detail view of the broadhead tip illustrated in FIG. 1.
Figure 5:
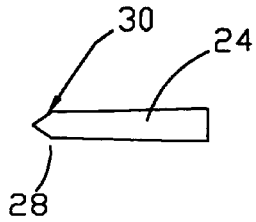
FIG. 5 is a detail view of the broadhead edge illustrated in FIG. 1.
Figure 6:
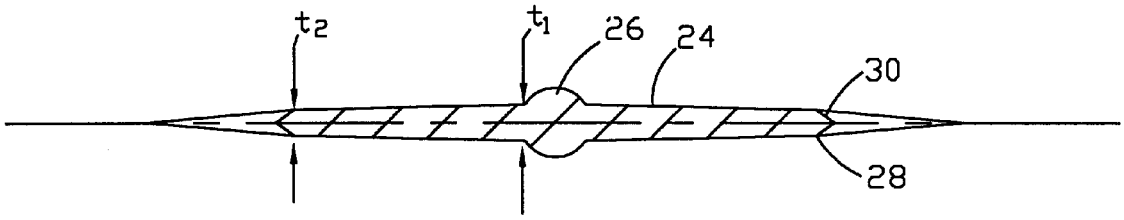
FIG. 6 is a cross-section view taken through line VI—VI in FIG. 1.

With reference now to FIG. 1–6, a first preferred embodiment of the present invention is illustrated. Broadhead 10 includes ferrule 12, body 14 extending from ferrule 12 and terminating at tip 16. By utilizing a powdered metallurgical manufacturing process, broadhead 10 is formed as a monolithic component. Ferrule 12 includes a threaded shank portion 18 and a shoulder portion 20 terminating at a conical head portion 22. Body 14 is formed by blade 24 extending laterally outwardly from either side of central longitudinal rib 26. As best seen in FIG. 6, the thickness $t_1$ of blade 24 adjacent central longitudinal rib 26 is greater than the thickness $t_2$ of blade 24 at outer edge 28 such that blade 24 has a tapered cross-section. Blade 24 also converges longitudinally toward tip 16 to form a generally triangular shaped body when viewed in a plan view. A cutting edge 30 is honed on outer edge 28 of blade 24 in a conventional manner.

A substantially conical shaped tip 16 is formed at the forward end of rib 26 opposite ferrule 12. The leading surface 32 of tip 16 has a slightly convex shape providing a bullet-like projectile for initiating contact with the target of broadhead 10. The trailing surface 34 of tip 16 is radiused inwardly to provide a smooth transition onto body 14. Blade 24 is provided with cutouts or apertures 36 formed therein for reducing the mass of broadhead 10.

Figure 7:
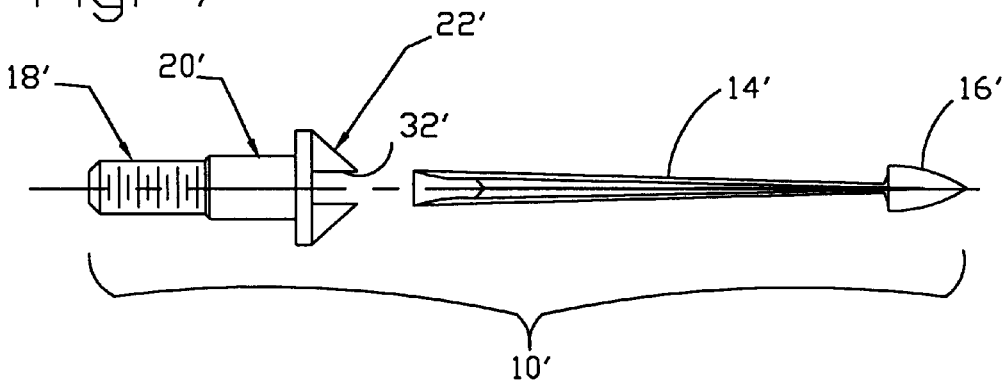
FIG. 7 is an exploded side view showing the configuration of the broadhead having bi-metal components in an unassembled state.

With reference now to FIG. 7, a bi-metal broadhead 10', similar in design to broadhead 10, is illustrated which utilizes differing metals for ferrule 12' and body 14'. For example, ferrule 12' may be formed out of high strength, relatively low hardness material such as 4140 alloy steel to provide adequate durability, while body 14' may be formed out of a high hardness material such as stainless steel or titanium to maintain a sharp cutting edge. In this regard, ferrule 12' and body 14' are formed as individual components in separate mold cavities. Ferrule 12' has a slot 32' formed in head portion 22'. Body 14' is received within slot 32' prior to sintering. The sintering process molecularly joins ferrule 12' and body 14' together to form monolithic bi-metal broadhead 10'.

As previously indicated, broadhead 10 is manufactured using a powdered metallurgical manufacturing process resulting in a monolithic component. The powdered metallurgical process provides greater control over the shape and weight of the broadhead, and also improves the overall strength of broadhead 10. Furthermore, the powdered metallurgical process eliminates many fabricating and machining steps associated with conventional broadhead manufacturing.

Figure 8A:
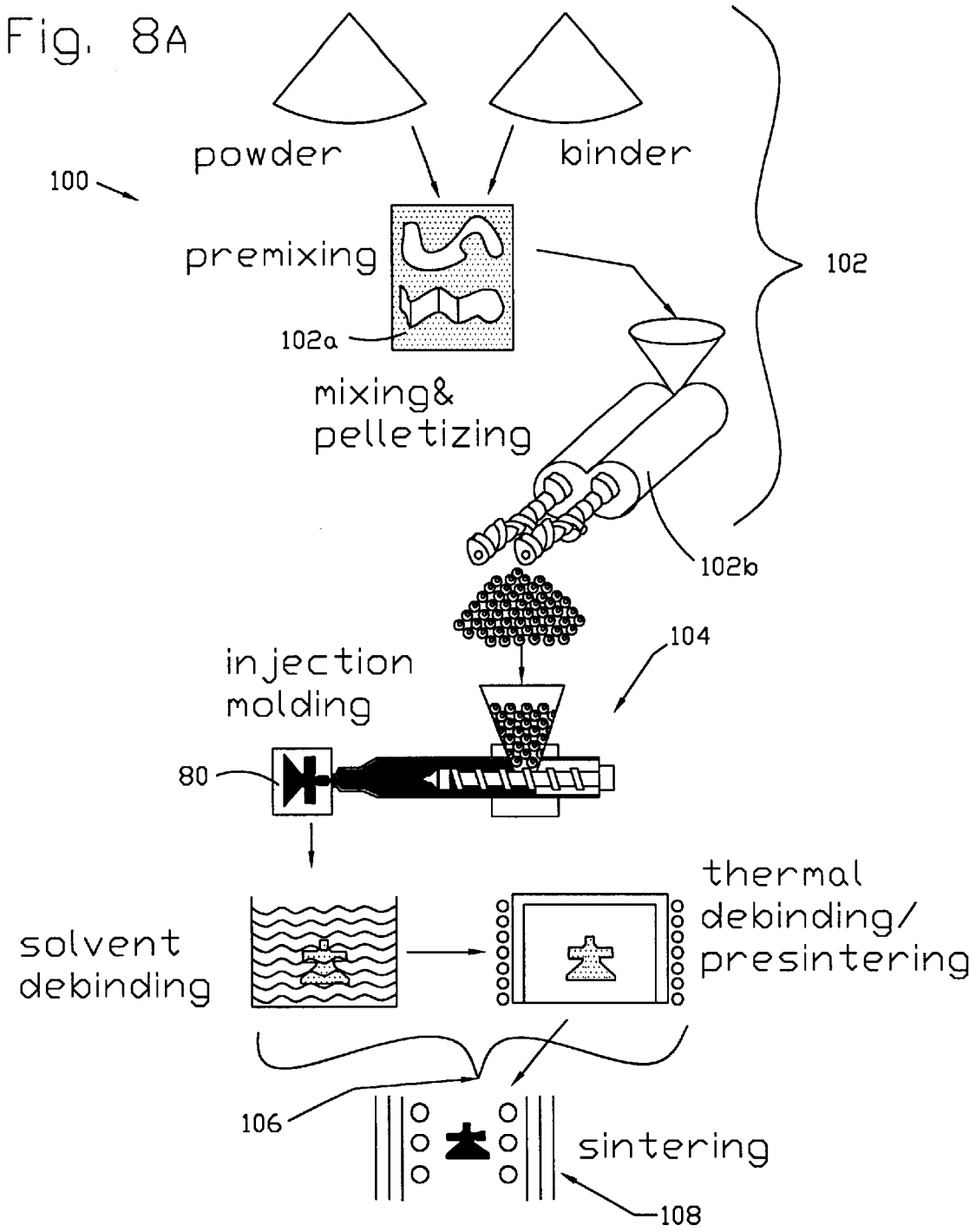
FIG. 8A is a schematic diagram generally illustrating the method of manufacturing a broadhead using powdered metallurgy technology.
Figure 8B:
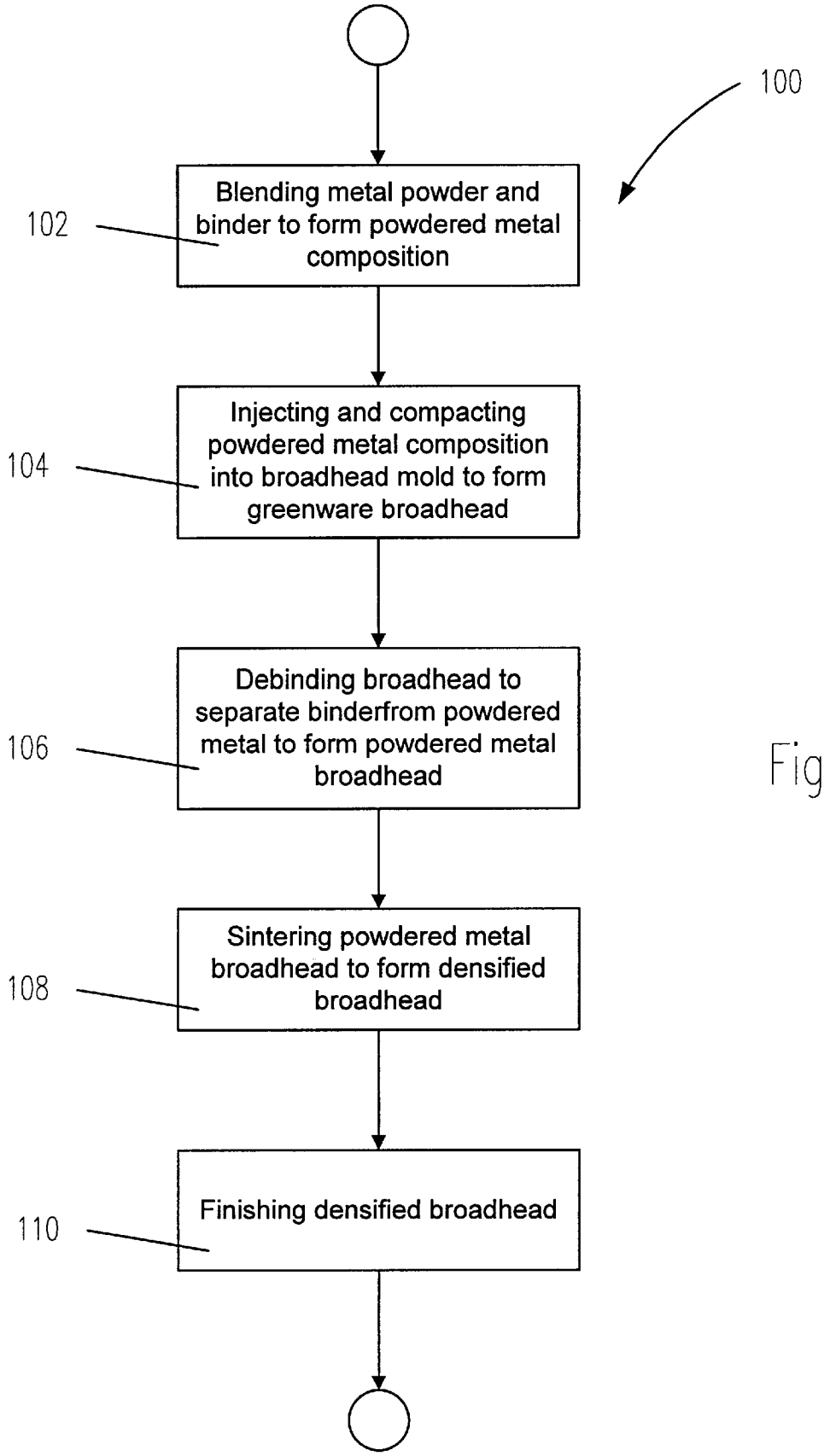
FIG. 8B is a flow chart illustrating the method of manufacturing a single metal broadhead using powdered metallurgy technology.

With reference now to FIGS. 8A and 8B, a method of manufacturing a single metal broadhead in accordance with the present invention will now be described. The method of manufacture is schematically illustrated in flow chart 100. The manufacturing process is initiated by blending metal powder and binder to form a powdered metal composition as represented at block 102. When blending the metal powder and binder are typically premixed in a first blending step 102*a* and then fully mixed to a nearly homogeneous mixture and pelletized in a second blending step 102*b*. In this regard, the particular metal such as high carbon steel or titanium is mixed with a suitable binder such as plastic or wax to form a powdered metal composition. Next, as represented in block 104, the powdered metal composition is injected into a broadhead mold 80 having the particular design configuration illustrated in FIGS. 1–6. Through the use of pressure or other means, the powdered metal composition is compacted into a greenware broadhead having the precise geometric configuration of the final product (although approximately 20% larger than the end design to account for shrinkage during subsequent processing) and moderate densification (on the order of approximately 50% densification).

Next, as represented in block 106, the greenware broadhead is processed to separate the binder from the metal without melting the constituent metal, thereby forming a powdered metal broadhead. As presently preferred, the greenware broadhead is immersed in a solvent to separate a portion of the binder from the powdered metal. The greenware broadhead is removed from the solvent and placed in a thermal debinding furnace where any remaining binder is burned off. The thermal debinding furnace may also be employed to perform a pre-sintering step. While the debinding step is described as a combination of chemical and thermal processes, one skilled in the art will readily recognize that any process or combination of processes could be employed to debind the greenware broadhead. At this point, the powdered metal broadhead is still in a moderate densification state.

As represented at block 108, the powdered metal broadhead is next placed in an sintering furnace and sintered at an elevated temperature and pressure to increase the density thereof. In this regard, the sintering processing parameters are defined such that the broadhead reaches a density of approximately 97%–98%. During the sintering process, the overall size of the broadhead shrinks approximately 20%. Once sintering is complete, the broadhead has the final geometry and does not require further machining. In this regard, threaded portion 18 is already formed in ferrule 12 and tip 16 is formed at the end of body 14. Lastly, as represented at block 110, outer edge 28 is lightly honed to provide a razor sharp edge 30.

Figure 9:
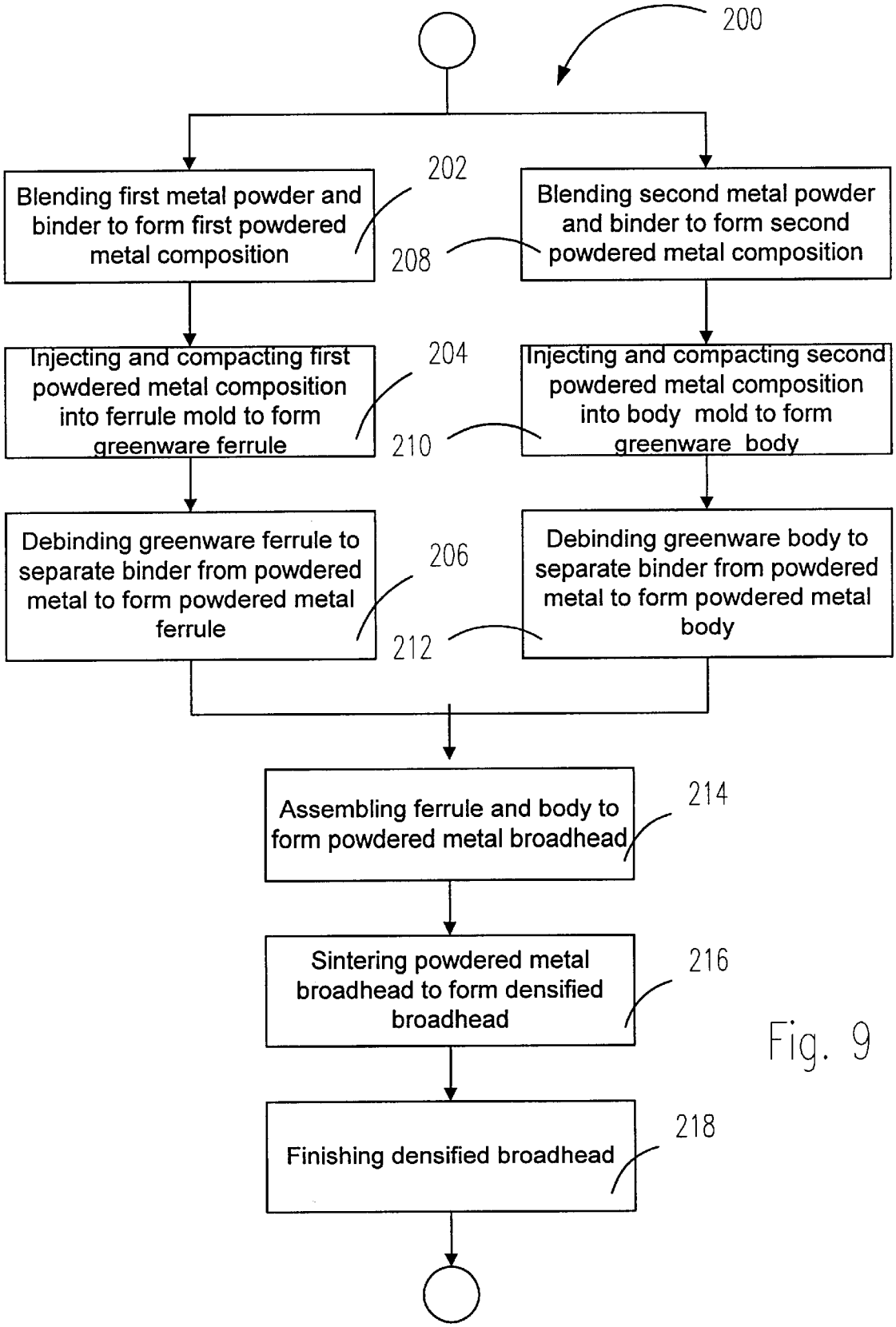
FIG. 9 is a flow chart illustrating the method of manufacturing a bi-metal broadhead using powdered metallurgy technology.

With reference now to FIG. 9, a method of manufacturing a bi-metal broadhead in accordance with the present invention will now be described. The method of manufacture is schematically illustrated in flow chart 200. As represented in block 202, a first powdered metal composition is formed by blending a first metal constituent such as 4140 alloy steel with a suitable binder. Next, as represented in block 204, the first powdered metal composition is injected into a mold cavity having the particular design configuration for the ferrule 12'. Through the use of pressure or other means, the first powdered metal composition is compacted into a greenware ferrule having moderate densification. Next, as represented in block 206, the greenware ferrule is processed to separate the binder from the metal without melting the constituent metal, thereby forming a powdered metal ferrule which is still in a moderate densification state.

As represented in block 208, a second powdered metal composition is formed by blending a second metal constituent such as stainless steel or titanium with a suitable binder. Next, as represented in block 210, the second powdered metal composition is injected into a mold cavity having the particular design configuration for the body 14'. Through the use of pressure or other means, the second powdered metal composition is compacted into a greenware body having moderate densification. Next, as represented in block 212, the greenware body is processed to separate the binder from the metal without melting the constituent metal, thereby forming a powdered metal body which is still in a moderate densification state.

Next, as represented at block 214, body 14' is inserted into slot 32' formed in ferrule 12' to form a powdered bi-metal broadhead having a moderate densification. Next, as represented at block 216, the powdered bi-metal broadhead is sintered at an elevated temperature and pressure to increase the density thereof. In this regard, the sintering process parameters are defined such that the ferrule and body are molecularly joined resulting in a monolithic broadhead having a density of approximately 97%–98%. Lastly, as represented at block 218, outer edge 28' is lightly honed to provide a razor sharp edge 30'.

Figure 13:
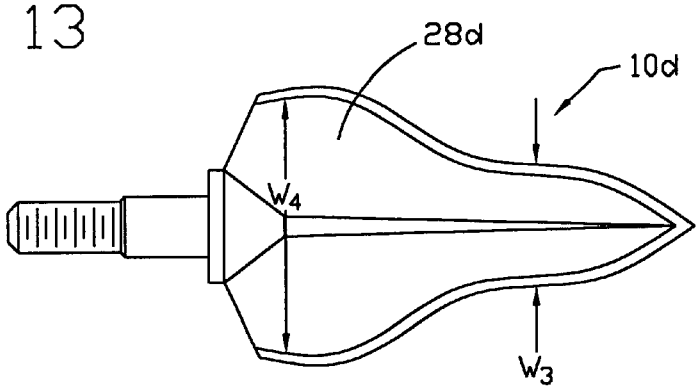
FIGS. 10–13 are top plan views showing various geometric configurations of an archery broadhead in accordance with the present invention.
Figure 10:
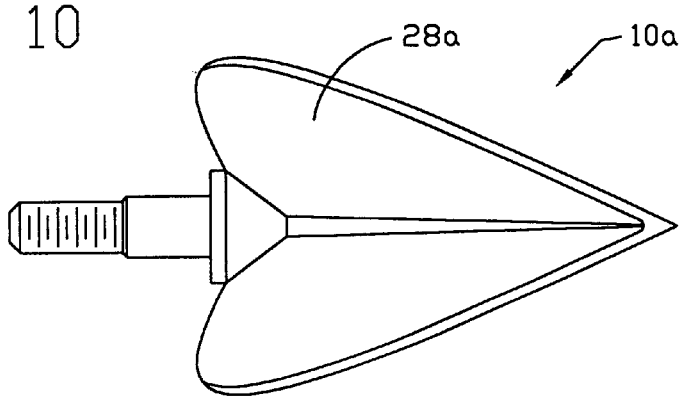
Figure 11:
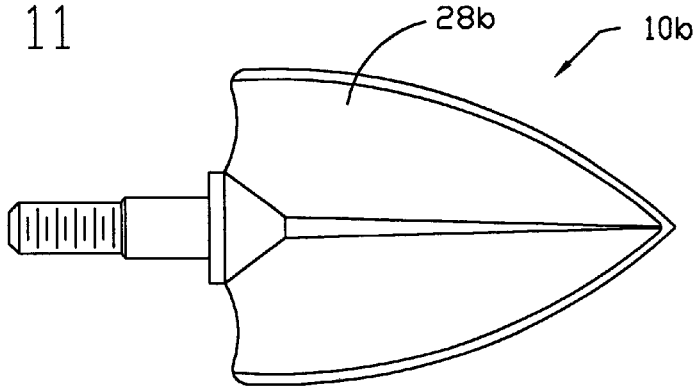
Figure 12:
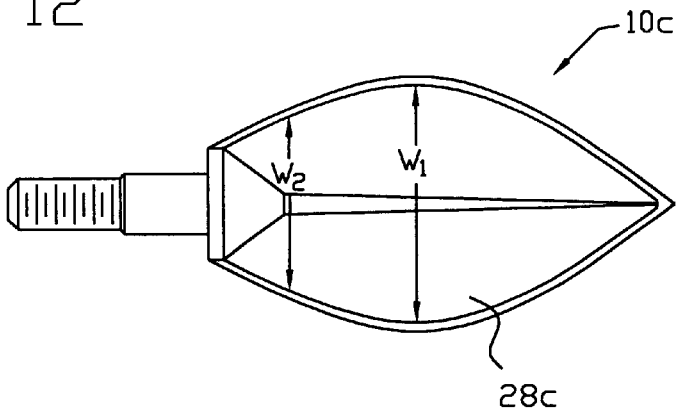

With reference now to FIGS. 10–13, various broadhead configurations are illustrated which can be fabricated in accordance with the present invention. In this regard, one skilled in the art will readily recognize that the powdered metallurgical process, and specifically the molding step associated therewith, accommodates complex geometric configurations without significantly increasing the complexity or cost of the manufacturing process. For example, as illustrated in FIGS. 10 and 11, the generally triangular shaped broadheads 10*a*, 10*b* may incorporate curvilinear outer edges 28*a*, 28*b*. Alternately, as illustrated in FIG. 12, the broadhead 10*c* may take on a more elliptical or ovoid appearance in which the width ($w_1$) of the outer edge 28*c* in the middle of blade 24*c* is greater than the width ($w_2$) of the blade 24*c* at head portion 22*c* of ferrule 12*c*. As illustrated in FIG. 13, the outer edge 28*d* of broadhead 10*d* may include a complex curvature such that broadhead 10*d* has a relatively narrow nose portion extending approximately 40% of the length of the broadhead. In this regard, the width ($W_3$) nose portion is approximately 30% of the width ($w_4$) at the base portion. A middle portion of broadhead 10*d* includes a compound curvature which provides a smooth transition from the nose portion to the base portion.

Figure 15:
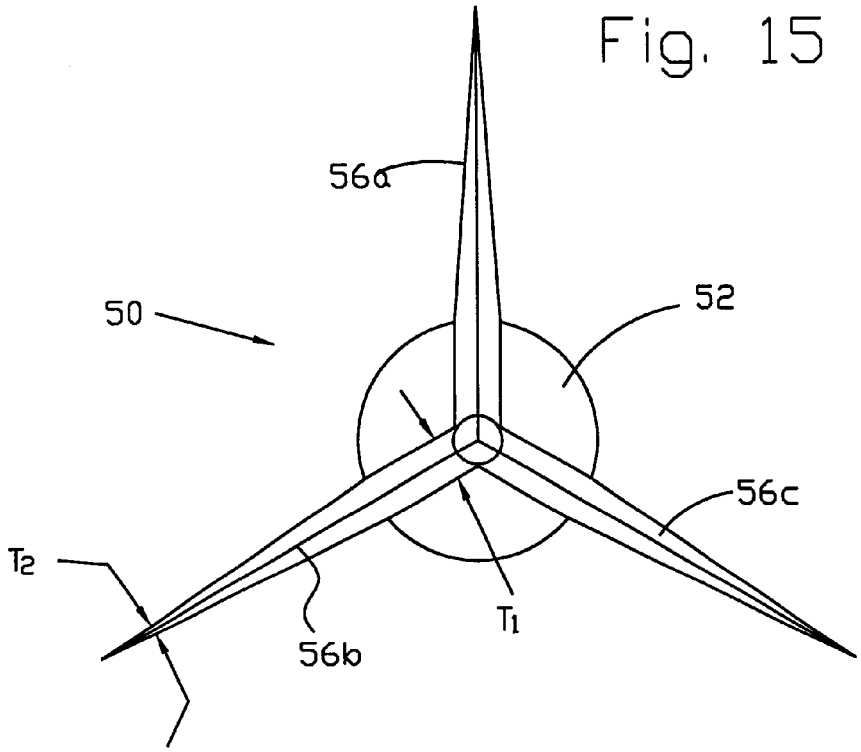
FIG. 15 is an end view of the broadhead illustrated in FIG. 14.
Figure 14:
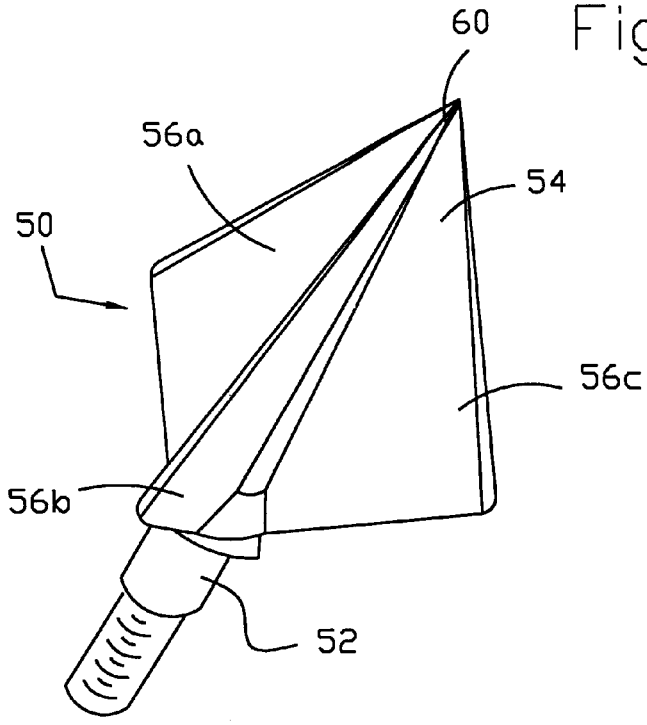
FIG. 14 is a perspective view of a second preferred embodiment of an archery broadhead in accordance with the present invention.

With reference now to FIGS. 14 and 15, a second preferred embodiment of the present invention is illustrated. Broadhead 50 includes a ferrule 52 and a body 54 having three blades 56*a*, 56*b*, 56*c* arranged in an equiangular relationship. As best seen in FIG. 15, the thickness $t_1$ of blades 56 at their intersection is greater than the thickness $t_2$ of blades 56 at outer edge 58*a*, 58*b*, 58*c* such that blades 56 have a tapered cross-section. Blades 56 also converge longitudinally toward a tip 60 to form a generally triangular shaped body when viewed in a plan view. The design of broadhead 50 is such that it made be in either a single metal design or a bi-metal design.

Figure 16:
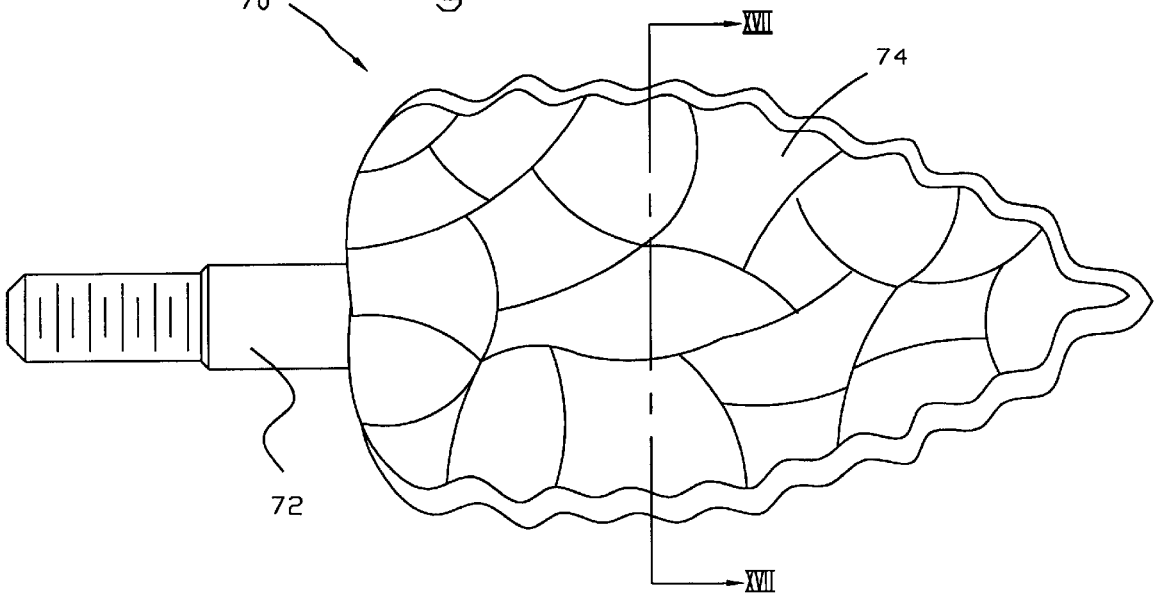
FIG. 16 is a top plan view of a third preferred embodiment of an archery broadhead in accordance with the present invention.
Figure 17:
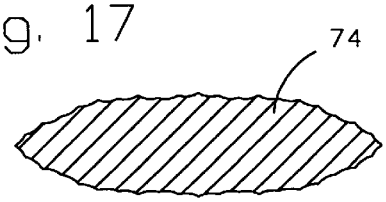
FIG. 17 is a side view of the broadhead illustrated in FIG. 16.

With reference now to FIGS. 16 and 17, a third preferred embodiment of the present invention is illustrated in which broadhead 70 has a ferrule 72 and a body 74. In this regard, the powdered metallurgical process may be used to provide a monolithic broadhead 70 in which the body 74 has an irregular configuration simulating that of a flint broadhead and a ferrule integral with the body 74 and extending therefrom for securing the broadhead 70 to an arrow shaft in a conventional manner. More specifically, the molding step associated with the powdered metallurgical process accommodates complex geometric configurations and non-constant thicknesses without significantly increasing the complexity or cost of the manufacturing process. In this manner, broadhead 70 is fabricated in a manner that give the appearance of being hand formed from a piece of flint or other stone, while at the same time providing a sharp razor-type edge found on modern broadheads.

From the foregoing description, one skilled in the art will readily recognize that the present invention is directed to a monolithic broadhead and a method of manufacturing same. While the present invention has been described with particular reference to various preferred embodiments, one skilled in the art will recognize from the foregoing discussion and accompanying drawing and claims, that changes, modifications and variations can be made in the present invention without departing from the spirit and scope thereof as defined in the following claims.

What is claimed is:

1. A method of manufacturing a monolithic broadhead comprising the steps of:

blending a metal powder and a binder to form a powdered metal composition;

providing a mold having a mold cavity defining a monolithic broadhead including a ferrule, a blade integrally formed with said ferrule and extending forwardly therefrom, and a tip integrally formed with said blade at an end opposite said ferrule;

injecting said powdered metal composition into said mold;

compacting said powdered metal composition in said mold to form a greenware broadhead;

debinding said greenware broadhead such that said binder separates from said metal powder to form a powdered metal broadhead;

sintering said powdered metal broadhead at an elevated temperature to form a sintered monolithic broadhead; and honing a cutting edge on an outer edge of said sintered monolithic broadhead.

2. The method of manufacturing a monolithic broadhead of claim 1 wherein the step of blending a metal powder and a binder comprises blending a metal powder having a carbon steel composition.

3. The method of manufacturing a monolithic broadhead of claim 1 wherein the step of sintering said powdered metal broadhead comprises sintering said greenware broadhead at said elevated temperature and at an elevated pressure.

4. A method of manufacturing a monolithic broadhead comprising the steps of:

forming a greenware broadhead from a powdered composition;

sintering said greenware broadhead at an elevated temperature to form a sintered monolithic broadhead; and honing a cutting edge on an outer edge of said sintered monolithic broadhead.

5. The method of manufacturing a monolithic broadhead of claim 4 wherein the step of forming a greenware broadhead comprises the step of forming a monolithic body having a ferrule, a blade integrally formed with said ferrule and extending forwardly therefrom, and a tip integrally formed on said blade at an end opposite said ferrule.

6. The method of manufacturing a monolithic broadhead of claim 5 wherein the step of forming a monolithic body comprises forming said blade having a thickness which is greater at a central longitudinal axis than a thickness at said outer edge.

7. The method of manufacturing a monolithic broadhead of claim 5 wherein the step of forming a monolithic body comprises the step of forming a central longitudinal rib extending through said blade from said ferrule to said tip.

8. The method of manufacturing a monolithic broadhead of claim 5 wherein the step of forming a monolithic body comprises the step of forming said tip as a generally conical shaped element.

9. The method of manufacturing a monolithic broadhead of claim 5 wherein the step of forming a monolithic body comprises the step of forming said blade having an aperture formed through an area interior of said outer edge.

10. The method of manufacturing a monolithic broadhead of claim 5 wherein the step of forming a monolithic body comprises the step of forming said ferrule having a shank portion and a head portion integrally formed at the intersection of said ferrule and said blade.

11. The method of manufacturing a monolithic broadhead of claim 4 wherein the step of forming a greenware broadhead comprises the step of forming a monolithic body having a ferrule, a plurality of blades equiangularly arranged and integrally formed with said ferrule to extend forwardly therefrom, and a tip integrally formed on said plurality of blades at an end opposite said ferrule.

12. The method of manufacturing a monolithic broadhead of claim 4 wherein the step of sintering said greenware broadhead comprises sintering said greenware broadhead at said elevated temperature and at an elevated pressure.

* * * * *

UNITED STATES PATENT AND TRADEMARK OFFICE

CERTIFICATE OF CORRECTION

PATENT NO. : 6,290,903 B1
DATED : September 18, 2001
INVENTOR(S) : Grace, Jr. et al.

It is certified that error appears in the above-identified patent and that said Letters Patent is hereby corrected as shown below:

Title page,
Item [56], References Cited, OTHER PUBLICATIONS,
"Cerameics" should be -- Ceramics --.
"Braodheads" should be -- Broadheads --.

Column 1,
Line 30, delete "red".

Signed and Sealed this

Sixteenth Day of July, 2002

*Attest:*

*Attesting Officer*

JAMES E. ROGAN
*Director of the United States Patent and Trademark Office*